United States Patent [19]

Davis, Jr.

[11] Patent Number: 4,977,690

[45] Date of Patent: Dec. 18, 1990

[54] DRIER WITH BLOWER MOTOR-HEATED AIR AND FLOW RECIRCULATION

[76] Inventor: Albert H. Davis, Jr., 541 Proctor Ave., Scottdale, Ga. 30079

[21] Appl. No.: 389,342

[22] Filed: Aug. 3, 1989

[51] Int. Cl.[5] ..... F26B 19/00

[52] U.S. Cl. ..... 34/243 R; 34/97; 34/100; 119/83

[58] Field of Search ..... 34/100, 97, 45, 133, 34/243 R, 219; 119/83, 85

[56] References Cited

U.S. PATENT DOCUMENTS

| | | | |
|---|---|---|---|
| 1,991,950 | 2/1935 | Martin | 34/100 |
| 2,027,694 | 1/1936 | List et al. | 34/100 |
| 2,910,783 | 11/1959 | Hoyt | 34/45 |
| 3,835,551 | 9/1974 | Keimpema et al. | 34/100 |

*Primary Examiner*—Henry A. Bennet
*Assistant Examiner*—John Sollecito
*Attorney, Agent, or Firm*—Harry I. Leon

[57] ABSTRACT

An apparatus in which the heat for blow drying a dog's hair is generated from the cooling of a motor and from fluid friction due to air being forced through passageways within the apparatus. The apparatus includes an enclosure and at least one blower motor combination such as the type used in vacuum cleaners. The blower forces air through the motor where the air is heated and then discharged into a pressurized section of the enclosure. Part of this air is then recirculated back to the blower inlet and the rest is discharged through an air hose that is used to dry the animal. A bypass valve is provided to adjust the fraction of the air that is recirculated. Controls are also provided to regulate the amount of fresh air that enters the enclosure and to vary the rotational speed of the blower motor. With proper adjustment of these controls, a very efficient pet hair drier cycle can be achieved.

6 Claims, 2 Drawing Sheets

DRIER WITH BLOWER MOTOR-HEATED AIR AND FLOW RECIRCULATION

BACKGROUND OF THE INVENTION

This invention relates to devices which dry hair both by blowing water off it and by evaporation.

On the market today are many commerical products used in human hair drying which comprise a blower and means for adjusting its speed and the temperature of the discharge air. Selinger, U.S. Pat. No. 3,430,353, improved the efficiency of such a hair dryer by having its discharge air recirculate over the hair. While saving on the thermal energy required to heat the recycled air, much of the energy saved by Selinger's device is consumed in evaporating the water present in the recycled air which is saturated with moisture.

Earlier, Marty, U.S. Pat. No. 2,827,060, utilized a valve to divert the heated air flow from a hari drier. With Marty's valve, part of the flow of the heated air can be diverted to a nozzle for rapid hair drying or to the brush for use in styling the hair.

Solar et. al., U.S. Pat. No. 4,097,722; Springer, U.S. Pat. No. 4,232,454; and Da Silva, U.S. Pat. No. 4,526,623, all realized the benefits of controlling the rate at which air is discharged from their devices.

While each of the hair driers in the cited prior art has a control with which one can vary the air discharge rate, each of these drier heats the air with the use of an electric heating element. Unfortunately, the use of such an element can overheat a dog's skin which is sensitive to high temperatures.

All the prior art references mentioned above realized an improvement to a hair drying apparatus by having controls with which to vary the air discharge rate. However, the means for heating, in each instance, was by the use of a electrical heating unit. For this and other reasons, hand-held driers such as those designed for blow drying human hair are not suitable for use with pets. Not only can such drier get an animal's skin too hot but also having an electric applicance so close to the animal is dangerous. Especially in the case of dogs, whose nature is to shake themselves to rid their fur of excess moisture, the water, when hurled off, can damage a hand-held drier and pose a potential electric shock hazard both to the animal and to the operator.

SUMMARY

The object of this invention is to provide a fast, safe means for drying a dog's or other animal's fur.

In accordance with the present invention, there is provided an apparatus for drying a dog's hair having at least one powerful blower driven by an electric motor in which the main heat source is the waste heat of the motor. Some heat is also added due to friction as air flows across the walls and through passageways of the drier. The use of a separate heating element is eliminated.

The apparatus comprises an enclosure divided into first and second chambers by a barrier. The blower is located in the first chamber and its motor in the second chamber. The barrier also supports the blower and its motor. Fresh air is drawn into the blower inlet through an opening in the first chamber. The rate in which air enters the enclosure is limited by a flapper-type valve placed on this opening. The blower-motor combination is so designed that the discharge from the blower is through the motor, cooling the motor and at the same time heating the air. The second chamber is pressurized by the air flow from the blower.

The apparatus also comprises a bypass pipe fluidly connecting the first and second chambers. The bypass pipe contains a flow control valve for controlling the amount of flow entering the bypass. The remainder of the heated air is discharged through an exit formed in the walls of the second chamber. A hose adaptor is supplied at the exit to which a flexible pressure hose can be fitted to direct the discharge to the animal. By proper adjustment of the bypass control valve, the air flow can be recirculated several times before discharge and, in this process, and considerable heat to the air.

For added flexibility of operation, the apparatus further comprises means for controlling the speed of the blower motor. With the proper adjustment of the motor speed controlling means as well as of the control valve in the bypass pipe and of the flapper-type inlet valve, a very efficient pet drier cycle can be achieved.

The preferred cycle is one in which initially the blower motor is run at low speed, the air intake is low and a high percentage of the air flow is recirculated. This combination gives a well warmed, light flow of air that immediately warms the animal and allows time for him to adjust to the drying operation. As the animal's fur dries, the air flow directed against it can be increased by speeding up the blower motor, reducing the percentage of the air flow which is recirculated and increasing the air intake rate. The flexibility of the operation of the apparatus is such that the operator can optimize its drying cycle to meet an individual animal's needs. For example, it has been found in practice that large, long-haired dogs like a higher air flow rate than do small, short-haired dogs.

DETAILED DESCRIPTION OF THE PREFERRED EMBODIMENT

Figure 1:
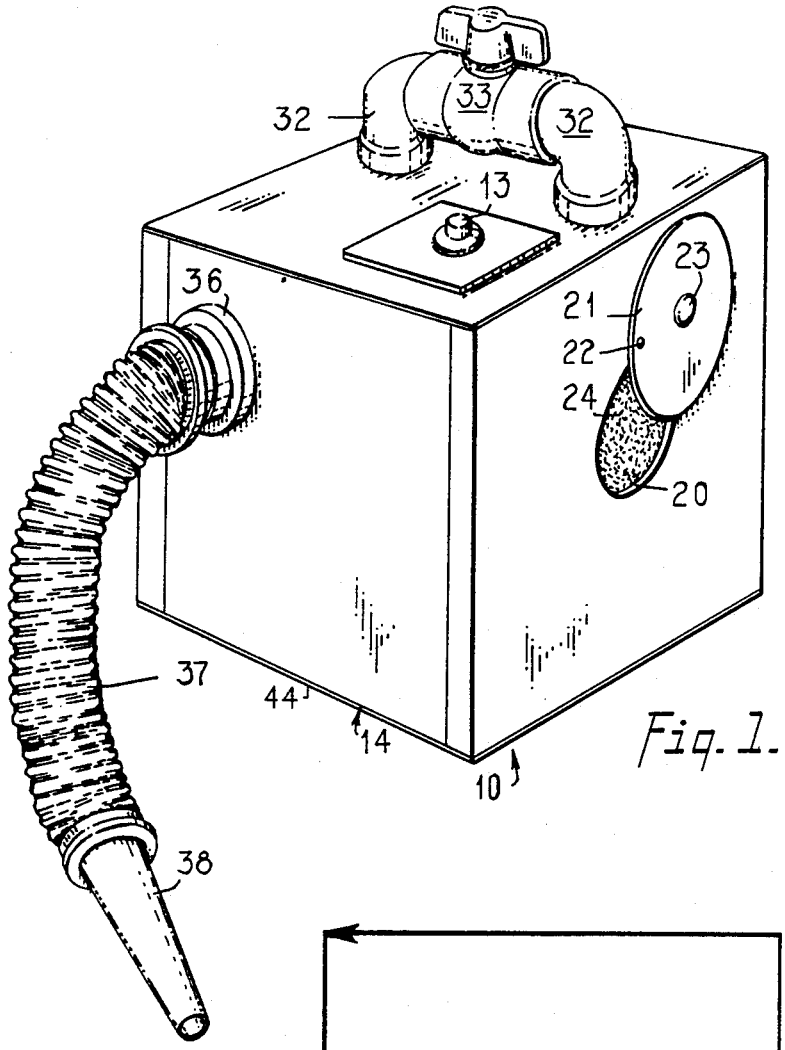
FIG. 1 is a perspective view of the drier according to the present invention.
Figure 2:
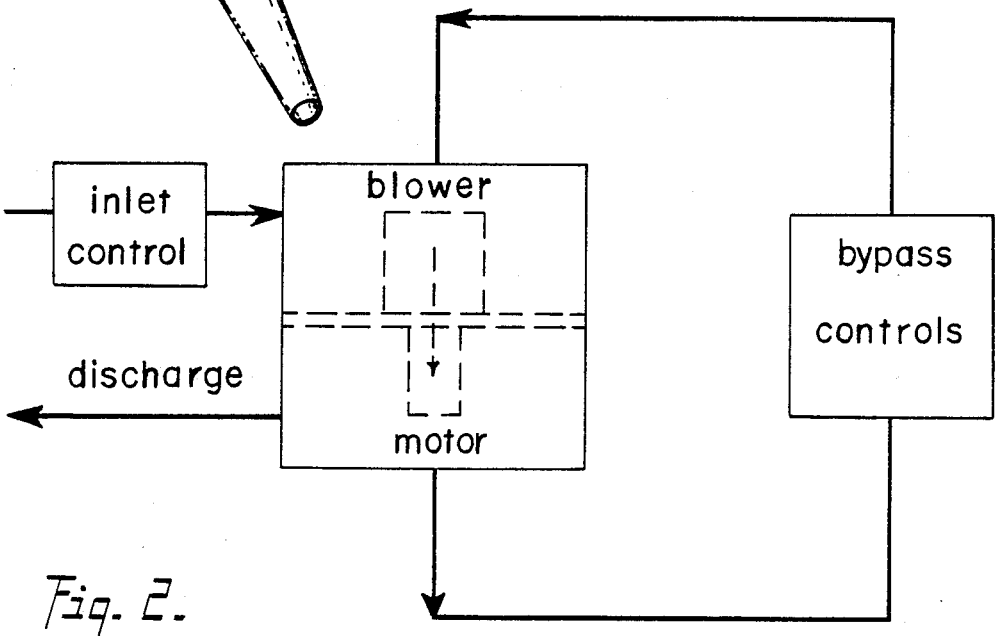
FIG. 2 is a schematic diagram showing the major components of the system and of the controls in the drier according to FIG. 1.

Referring to FIGS. 1–5, a hair dryer apparatus 10 comprises a pair of blowers 11, each driven by an electric motor 12. The blowers 11 are preferably of the type, that is used in vacuum cleaners and have high speed motors. Passageways in the motors 12 allow air to flow through the motors. To allow ease of control, each motor is preferably an universal ac/dc motor. The speed of the motor is regulated by a speed control 13. By turning a dial on the control 13 one can adjust the speed of the motor without loss of motor torque.

Figure 5:
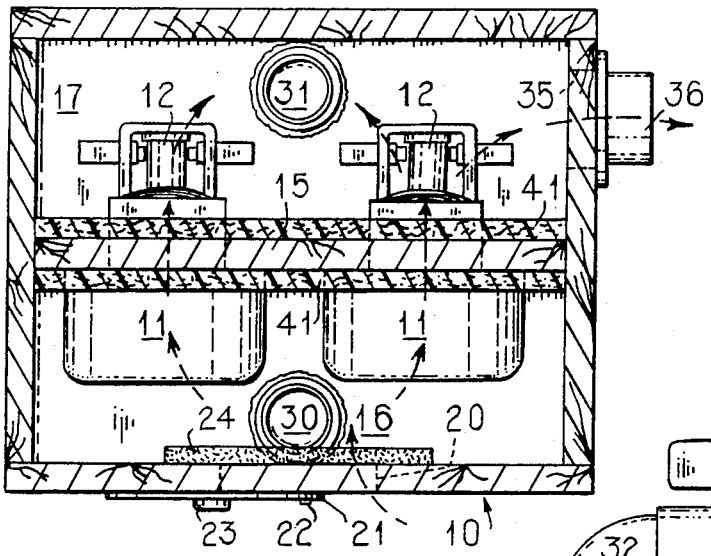
FIG. 5 is a cross-sectional view of the drier taken along line V—V of FIG. 3.
Figure 3:
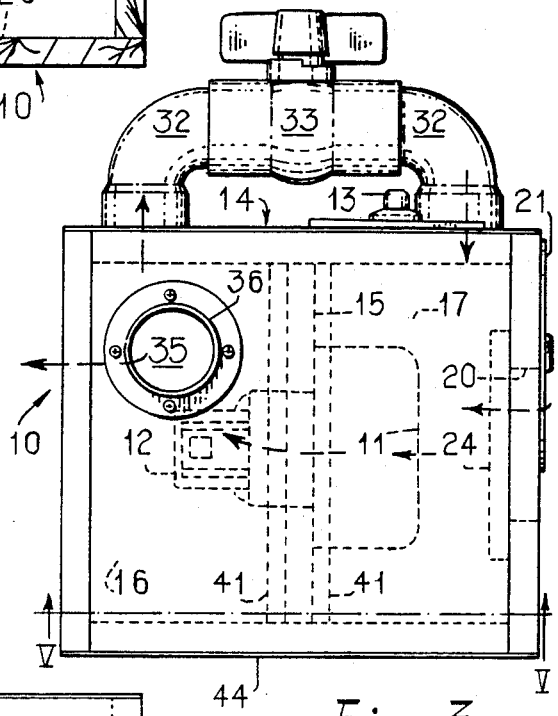
FIG. 3 is a side elevational view of the drier according to according to FIG. 1 without the flexible hose and nozzle.
Figure 4:
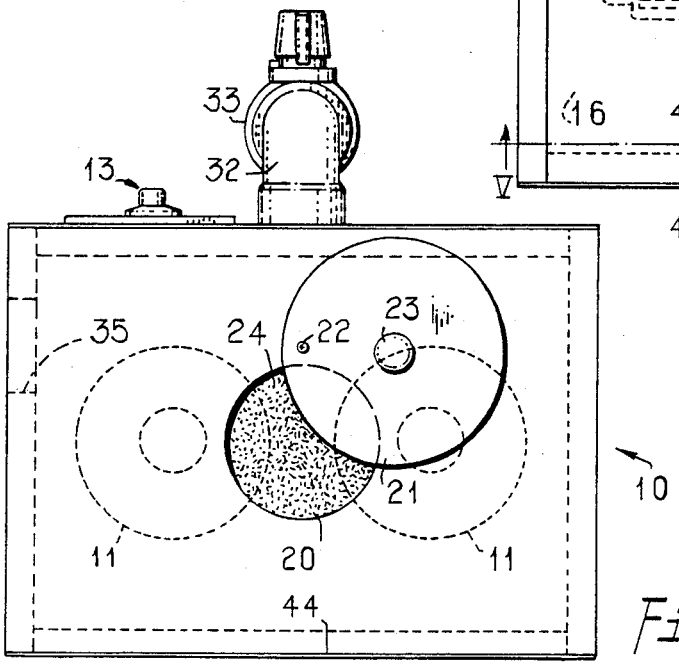
FIG. 4 is a front elevational view of the drier of the according to FIG. 3 without the hose adapter fitting.

The blowers 11 and their motors 12 are housed in a enclosure 14. A barrier 15 separates a first chamber 17 on the vacuum side of the enclosure 14 from a second chamber 16 on the pressure side (FIGS. 3–5). The barrier 15 also serves as a mounting site for the motors 12.

A wide variety of materials, including wood, plastic, or metal may be utilized to fabricate the enclosure 14 and the barrier 15. In the preferred embodiment, the enclosure 14 has the overall shape of a rectangular prism which, by way of example, is 11 inches in height and has a base 44 that measures 12 inches by 16 inches. Both the enclosure and 14 and the barrier 15 are preferably made from ¾ inch plywood, with the exterior surfaces of the enclosure being covered with a formica finish.

Air enters the apparatus 10 through and opening 20 in the first chamber 17. In order to keep dust from entering the apparatus 10, a filter 24 is positioned to cover the opening 20. In addition, a coverplate 21, which is pivotally mounted on a pin 22, can be positioned to partially block the opening 20. In the preferred embodiment, the opening 20 measures, by way of example, 4 inches in diameter; and the coverplate 21, made from a formica sheet, is 6 inches in diameter.

A handle 23 is provided to facilitate adjusting the position of the coverplate 21 relative to the opening 20. When the apparatus 10 is in use, the suction of air entering the opening 20 holds the coverplate 21 in its set position. However, even when the apparatus 10 is operating, only a small amount of force is needed to move the coverplate 21 across the opening 20 and into another desired position.

Drawn into the first chamber 17, air enters the blowers 11 and, as it is discharged, flows across the motors 12, cooling them. As the air cools the motors, the air itself becomes slightly heated. Downstream of the motors 12, the air enters the pressurized second chamber 16 from which a fraction of the air is then discharged. Exiting through an opening 35, the air passes first through a hose adaptor fitting 36 and then through a flexible hose 37 before being discharged through a nozzle 38. The heated air so discharged may be used to dry a dog (not shown).

The remainder of the air entering the second chamber is recirculated. This recirculated air travels first through an opening 31 in the chamber 16, then along a bypass pipe 32 and finally through a hole 30 back into the first chamber 17. A valve 33 is provided in the bypass line 32 to control the amount of the air that is recirculated. In the preferred embodiment, the bypass line comprises a 1½ inch pipe; and the valve 33 is a ball valve. The bypass line and valve may be either metal or plastic.

In order to reduce the noise level generated when the apparatus 10 is in operation, a sound adsorbent material 41 is placed within the enclosure 14. This adsorbent material may be a porous plastic as illustrated in FIG. 3 or a fibrous material such as fiberglass (not shown) which is placed directly around each motor 12 and blower 11.

When the apparatus 10 is used to dry a dog's hair, the preferred procedure especially for small, short-haired dogs, is to start by using the motors 12 at a low speed, with a low air intake rate and with a high percentage of the flow being recirculated. A well-warmed, light flow of air is produced, which can be applied directly to the animal. As the pet adjusts to the drying operation and his fur dries, the air flow can be increased by speeding up the blower motors 12, positioning the coverplate 21 to allow air to be drawn into the opening 20 at a greater rate, and opening the valve 33 to reduce the percentage of the air flow which is recirculated. Large dogs with long hair, unlike small, short-haired dogs, have been found to enjoy being dried with a higher air flow rate throughout the operation. The flexibility of operation of the apparatus allows the operator to optimize the drying cycle for the needs of an individual pet.

It is apparent from the foregoing that a new and improved apparatus for use in drying dogs has been provided. While only the presently preferred embodiment of the invention has been disclosed, as will be apparent to those familiar with the art, certain changes and modifications can be made without departing from the scope of the invention as defined by the following claims.

It is claimed:

1. A hair-drier for use with animals which comprises:

(a) at least one motor-fan unit of the type used in vacuum motors having a fan and a high speed motor through which air discharged by the fan flows, the motor being situated in the air flow downstream of the fan;

(b) an enclosure for the motor-fan unit having a barrier between the inlet and outlet of the fan;

(c) means for recirculating air from the outlet side of the fan back to the inlet side thereof;

(d) means for heating the air, the air being heated only by the motor-fan unit and friction between the air flow and interior surfaces of the enclosure and the recirculating means; and (e) means, including the barrier, for blocking any recirculation of air from the outlet side of the fan back to the inlet side thereof.

2. A hair drier according to claim 1 in which the recirculating means further comprises a pipe that fluidly connects the inlet and outlet sides of the fan and means for adjusting air flow through the pipe, the adjusting means including a control valve.

3. A hair drier according to claim 1 wherein the enclosure is further characterized as having an inlet through which the fan can draw air and which further comprises means for restricting the rate at which air can enter the inlet side of the fan, the restricting means including a plate that is pivotally connected to said enclosure and can be positioned so as to partially cover the inlet.

4. A hair drier for use with animals which comprises:

(a) at least one motor-fan unit having a fan and motor through which air from the fan can flow;

(b) an enclosure having at least one exterior wall and a barrier, the enclosure and the barrier forming first and second chambers, inlet and outlet sides of the motor-fan unit being disposed in the first and second chambers, respectively; and (c) means, including at least one pipe fluidly connecting the first and second chambers, for recirculating air from the second chamber back into the first chamber, the only air being recirculated being air which as yet to be discharged from an opening in the exterior wall for application to said animals.

5. A hair drier for use with animals having at least one motor-fan unit with a fan and motor through which air discharged by the fan can flow; an enclosure for the motor-fan unit; a barrier between the inlet and the outlet of the fan which also partitions the enclosure into two chambers; and means, including a bypass line fluidly connecting the two chambers, for heating the air using only the heat of the motor-fan unit and friction generated as the air is forced through the bypass line and the enclosure, the barrier having an opening for receiving each motor-fan unit, any fluid connection through the barrier between the inlet and the outlet of the fan being only through the motor of the motor-fan unit.

6. A hair drier according to claim 5 which further comprises means for discharging air from the enclosure to a point of use, the discharging means comprising a flexible hose.

* * * * *